US006357750B1

(12) United States Patent
Lievens

(10) Patent No.: US 6,357,750 B1
(45) Date of Patent: Mar. 19, 2002

(54) BALL REBOUND NET

(76) Inventor: Geert Lievens, 2648 Ellwood Dr., NE., Atlanta, GA (US) 30305

( * ) Notice: Subject to any disclaimer, the term of this patent is extended or adjusted under 35 U.S.C. 154(b) by 673 days.

(21) Appl. No.: 08/929,543

(22) Filed: Sep. 15, 1997

Related U.S. Application Data

(63) Continuation of application No. 08/699,476, filed on Aug. 19, 1996, now abandoned.

(51) Int. Cl.[7] ..... A63B 69/38
(52) U.S. Cl. ..... 273/395; 473/435; 473/459
(58) Field of Search ..... 273/26 A, 400, 273/396, 407, 410, 411, 395; 473/434, 435

(56) References Cited

U.S. PATENT DOCUMENTS

| | | | | | |
|---|---|---|---|---|---|
| 2,005,241 | A | * | 6/1935 | Robinson | 473/462 |
| 2,992,002 | A | | 7/1961 | Bingham | 273/95 |
| 3,456,945 | A | * | 7/1969 | Epply | 473/435 |
| 3,697,068 | A | | 10/1972 | McDougall | 273/29 |
| 3,989,246 | A | | 11/1976 | Brown et al. | 273/29 |
| 4,140,313 | A | | 2/1979 | Martin | 273/29 |
| 4,204,679 | A | | 5/1980 | Kreuzman | 273/29 |
| 4,264,070 | A | * | 4/1981 | Torres | 273/407 |
| 4,456,251 | A | | 6/1984 | Balaz | 273/29 |
| 4,456,252 | A | | 6/1984 | Hartland | 273/29 |
| 4,489,941 | A | * | 12/1984 | Shieh | 273/407 |
| 4,693,472 | A | | 9/1987 | Newman et al. | 273/29 |
| 4,703,931 | A | * | 11/1987 | Steen | 273/26 A |
| 4,743,020 | A | | 5/1988 | Meurer | 273/29 |
| 4,852,889 | A | | 8/1989 | Tomczak | 273/29 |
| 5,054,791 | A | * | 10/1991 | Ball | 273/396 |
| 5,342,063 | A | * | 8/1994 | O'Brien | 273/396 |
| 5,344,138 | A | | 9/1994 | Hellriegel | 273/29 |
| 5,402,999 | A | * | 4/1995 | Keehn, Sr. | 273/410 |
| 5,407,211 | A | * | 4/1995 | Bottiglieri | 273/26 A |
| 5,452,896 | A | * | 9/1995 | Core | 273/26 A |
| 5,467,990 | A | * | 11/1995 | Kitzhaber | 273/26 A |
| 5,562,288 | A | * | 10/1996 | Erkebaev | 273/396 |

* cited by examiner

*Primary Examiner*—Mark S. Graham
(74) *Attorney, Agent, or Firm*—Needle & Rosenberg, P.C.

(57) ABSTRACT

A ball returning device comprising a frame and a net disposed within the frame, wherein the horizonal members of the frame are nonlinear so that the attached net is in two sections having a nonlinear angle therebetween. In an alternate embodiment of the present invention, the net is connected to three upstanding members in a nonlinear alignment so that two sections are formed in the net. The adjacent, nonlinear sections in the net improve the practice quality of the user for such games as tennis.

23 Claims, 3 Drawing Sheets

BALL REBOUND NET

This application is a con't of Ser. No. 08/699,476 filed Aug. 19, 1996.

BACKGROUND OF THE INVENTION

1. Field of the Invention

The present invention relates to a device for rebounding a ball to practice a ball sport, such as tennis, baseball, cricket, and the like.

2. Background Art

Devices used to practice ball sports, such as tennis and other games, have been known in the art. Some prior art devices encompass using hard surfaces made of brick or concrete to rebound a ball. Examples of those devices are shown in U.S. Pat. No. 3,697,068, issued to McDougall, and U.S. Pat. No. 4,852,889, issued to Tomczak. Other prior art devices teach a net to rebound a ball, including U.S. Pat. No. 2,992,002, issued to H. Bingham, Jr., U.S. Pat. No. 4,140, 313, issued to Martin, U.S. Pat. No. 4,456,251, issued to Balaz, and U.S. Pat. No. 4,693,472, issued to Newman et al. One common characteristic of these prior art devices is that they have a flat face from which a ball rebounds. These prior art devices, accordingly, fail to provide an "element of surprise" to the player using them.

Another prior art device, U.S. Pat. No. 4,743,020 issued to Meurer, teaches a net stretched on a circular frame to form a parabolic or curved shape. According to the description, the player using this device will know where to expect the rebounding ball to return. Thus, the element of surprise is missing in this device also.

Thus, there is a need in the art for a ball rebound net that provides an element of surprise in the rebounding ball for a novice player.

A need exists in the art for a net that provides a different rebound trajectory for shots hitting different parts of the net. Such a net would allow the player to improve his practice session.

Yet another need in the art is for a rebound net that allows a player to practice cross-court shots.

SUMMARY OF THE INVENTION

The above disadvantages of the prior art are overcome by the present invention, which is a ball returning device comprising a net and a means for supporting the net in a substantially upright position so that the net elastically rebounds a ball contacting it. The supporting means orients the net so that it forms at least two sections. The adjacent sections of the net are not linear with each other so that the intersection forms an angle therebetween.

In the preferred embodiment, the net supporting means comprises a frame having four members, or sides. Each end of one member connects to the end of the adjacent member to form a corner therebetween. The frame is preferably rectangular in shape, having two horizontally disposed members and two upstanding members.

The present invention further comprises a means for pivoting the opposed ends of the horizonal members relative to each other. Preferably, the pivoting means is a pivot point disposed in the middle of each horizonal member so that the horizonal members are nonlinear to one another.

In the preferred embodiment, a nonelastic net is attached to the four members of the frame by an elastic securing means which comprises a plurality of elastic cords attaching a portion of the net, preferably the edge, to the pivot point and another portion of the net to each of the four corners. The net is stretched among these six attachment points so that it generally assumes the form of the frame. Thus, two sections are formed in the net when there is one pivot point in the two horizonal members. Accordingly, when the pivot point in each horizontal member forms an angle between 0 and 180 degrees, the net is substantially "V" shaped in a horizonal plane.

The nonlinear sections that exist in the present invention cause a ball to rebound differently compared to prior art devices. A ball rebounding from a flat surface, such as a net, blackboard, or wall, follows a reasonably expected trajectory and fails to provide an element of surprise. The present invention, conversely, provides an unexpected trajectory to the rebounding ball for the novice player. The resulting variations in the rebounding ball improve the quality of the practice session.

Different rebound trajectories occur depending on the location that the ball contacts the net. When the ball hits near the center, it returns most predictably and with the smallest velocity loss. The return speed, however, is less than the impact speed because of energy losses that occur as the ball rebounds. The tension in the elastic cords can be adjusted so that the return time is substantially equivalent to the time that it takes the ball to travel across a full-sized court and back in an actual tennis volley. This provides the player with sufficient time to prepare for the next stroke. The energy absorption in the net creates this delay in return and allows an advanced player to hit strokes at full force in succession.

Since the multiple sections of the net in a nonlinear arrangement result in different return characteristics, the present invention allows a change in direction of the ball so that both backhand and forehand shots can be practiced. For a right-handed player, the ball hitting the right side of the net that has two sections returns the ball to the player's backhand. The ball hitting the left side of the net, conversely, returns the ball to the player's forehand.

The rebounding ball returns substantially perpendicular to the surface of the net that it contacts. Thus, as the location of the ball contact varies horizontally along one section of the net, the return trajectory also varies. This varied return characteristic of the present invention does not intuitively follow the novice player's expectations and, accordingly, creates an element of surprise. The advanced player, however, can become accustomed to the return trajectories so that they become predictable. Thus, it is possible for the advanced player to practice both backhand and forehand shots at full force while the player's skill level is constantly challenged.

Another advantage of the present invention is that it can absorb sufficient energy from the rebounding ball so that the present invention can be used in small areas. Similarly, the time that it takes the ball to return to the player can be controlled by adjusting the tension in the elastic cords. The return time is preferably substantially equivalent to the time that it takes the ball to travel across a full-sized court and back in an actual tennis volley.

In addition, the present invention encompasses a method for a player to practice hitting a ball, comprising the steps of:

a. providing a net having a surface;

b. supporting the net so that the surface of the net forms two sections, the two sections having a nonlinear angle therebetween viewed in a horizonal plane;

c. hitting the ball toward the net, wherein the ball contacts the surface of the net; and d. elastically rebounding the ball from the surface of the net substantially toward the player so that the player may repeat the hitting step.

The present invention further encompasses a method for erecting a ball returning device, comprising the steps of:

a. providing a net having a surface; and b. supporting the net so that the surface of the net forms two sections, the two sections having a nonlinear angle therebetween viewed in a horizonal plane, wherein when a ball contacts the surface of the net, the ball elastically rebounds from the surface of the net.

DETAILED DESCRIPTION OF THE INVENTION

Figure 1:
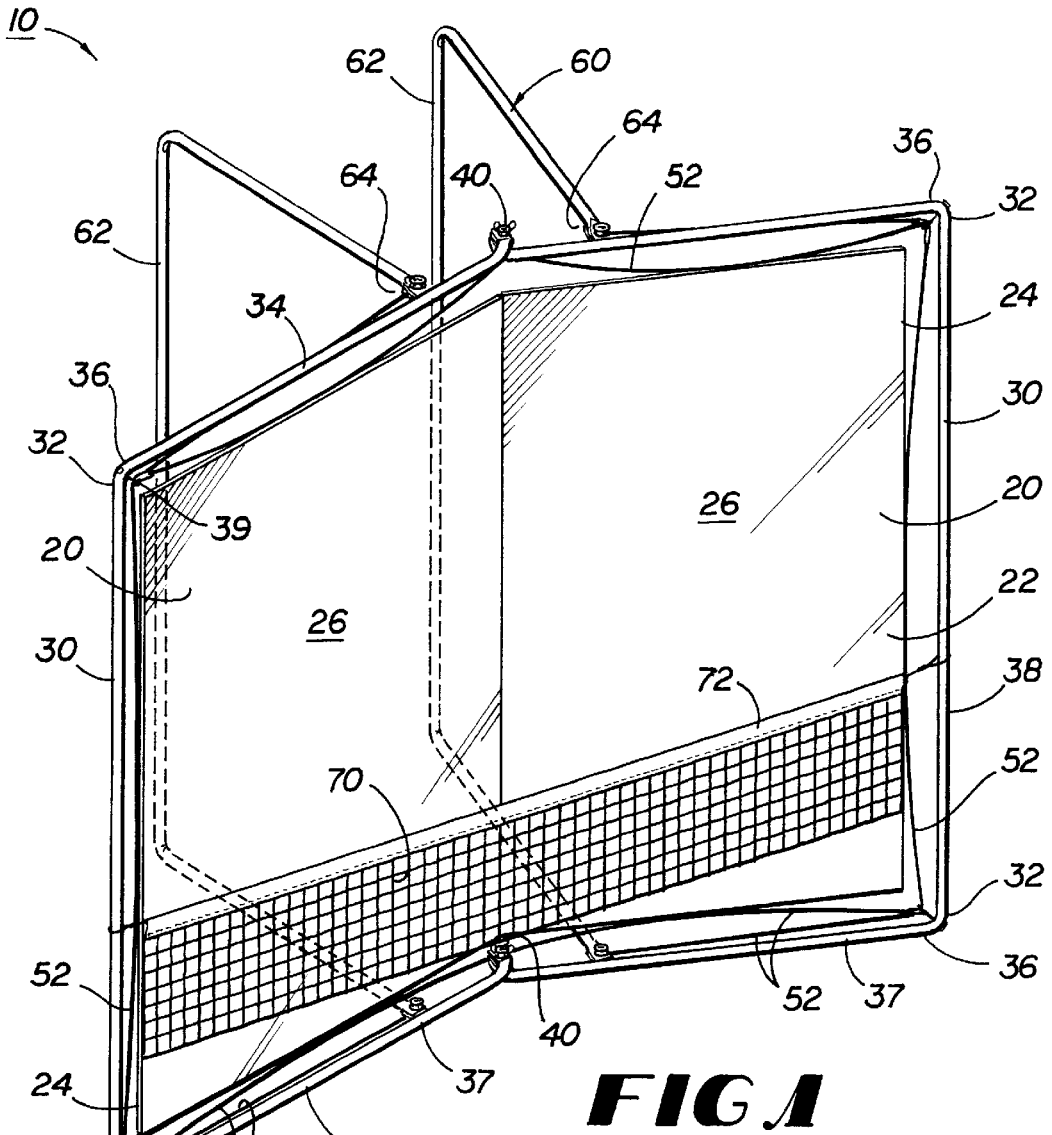
FIG. 1 is a perspective view of one embodiment of the present invention.

The present invention is more particularly described in the following examples that are intended as illustrative only since numerous modifications and variations therein will be apparent to those skilled in the art. As used in the specification and in the claims, "a" can mean one or more, depending upon the context in which it is used.

As shown in FIGS. 1–4, the present invention is a ball returning device 10 comprising a net 20 and a means for supporting the net 20 in a substantially upright position that elastically rebounds a ball therefrom. The net 20 has a body portion 22 and an edge 24 circumscribing the body portion 22. The supporting means orients the net 20 so that the body portion 22 forms at least two sections 26 in which the intersection of adjacent sections 26 forms an angle θ therebetween. The angle θ between adjacent sections 26 is nonlinear (e.g., not 180 degrees) when viewed in the horizonal plane, such as a top plan view shown in FIGS. 3 and 4.

The net supporting means preferably comprises two substantially upright members 30 disposed on opposite edges 24 of the net, a means for positioning the sections 26 of the net 20 relative to each other, and a means for connecting the net 20 to both the upright members 30 and the positioning means. Each upright member 30 has opposed ends 32 and preferably is vertically disposed.

The positioning means is disposed intermediate the upright members 30. In the preferred embodiment shown in FIGS. 1–3, the positioning means comprises two substantially horizontally disposed members 34 having opposed ends 36 and a pivot point 40 disposed therebetween. Each end 36 of each horizonal member 34 is connected to a respective end 32 of one upright members 30 to form a coner 39 so that 10 the two upright members 30 and two horizonal members 34 form a frame 38. As best shown in FIG. 1, the frame 38 has four members or sides 30, 34. Each member 30, 34 is disposed substantially parallel to another one of the members so that there are two substantially horizontally disposed members 34 and two upstanding members 30.

The frame 38 should be constructed of a lightweight, rigid material to be easily transportable but yet, of course, be durable enough to stand up to repeated usage. A thin-walled steel pipe having a one-inch outer diameter has been found to be sufficient for a nonelastic net 20 that is seven feet by nine feet.

Although a rectangular, or a square, frame 38 is desired for manufacturing, assembly, and engineering considerations, it is contemplated that the frame 38 can have other shapes. An example is a four-sided trapezoid in which the top end 32 of at least one upright member 30 extends outwardly relative to its bottom end 32. That is, the upright members 30 extends outwardly and co-planarly with the section of net 20 adjacent that upright member 30 so that the upright member 30 is disposed at an angle relative to a vertical plane. Another embodiment has a frame 38 having a different number of sides, such as a triangle, a pentagon, a hexagon, an octagon, and the like.

The pivot point 40 is disposed between the opposed ends 36 of the horizonal members 34 and allows the ends 36 to be pivoted relative to each other. Although it is possible to orient the pivot point 40 to make the horizonal members 34 linear, similar to the prior art devices, the pivot point 40 in the present invention is oriented to cause the horizonal member 34 to be nonlinear. In the preferred embodiment shown best in FIG. 2, the pivot point 40 comprises a bolt 42 connecting two adjacent segments 37, or sections, of each horizonal member 34. A nylon washer is disposed intermediate the two segments 37 of the horizonal members 34; the end nut 44 tightened onto the bolt 42 is a lock nut. This combination of the washer and bolt 42 keeps the pivot point 40 under a constant pressure so that the pivot point 40 can be set and held at a desired angle θ.

Referring back to FIG. 1, at least a portion of the body portion 22 of the net 20 is disposed intermediate the members of the frame 38. In addition to connecting the net 20 to the coners 39 of the frame 38, the connecting means also connects a portion of the net 20 to the pivot points 40, preferably connecting the edge 24 of the net 20 to the pivot points 40. When one pivot point 40 exists in each of the two horizonal members 34, two sections 26 are formed in the net 20. Accordingly, there would be three sections 26 formed in the net 20 if two pivot points 40 are used in each of the horizonal members 34. Because the connecting means connects the net 20 to the coners 39 of the frame 38 and the pivot points 40, the sections 26 of the net 20 form an angle θ therebetween substantially the same as the angle formed by the pivot point 40. Thus, when the pivot point 40 forms an angle between 0 and 180 degrees, the net 20 is substantially "V" shaped in a horizonal plane, as shown in FIGS. 3 and 4.

Figure 3:
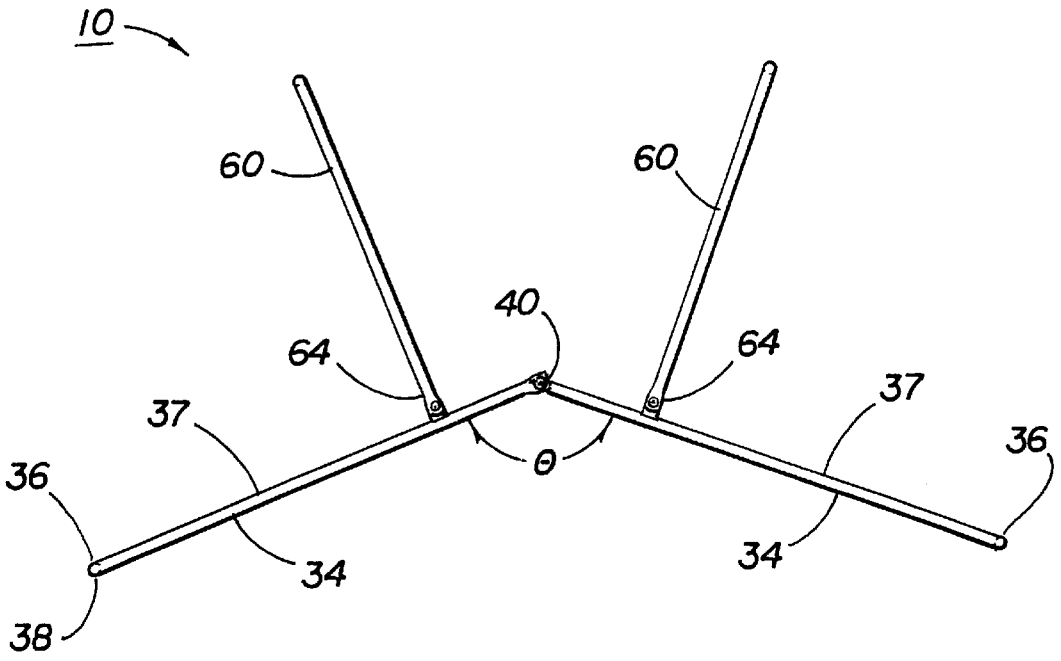
FIG. 3 is a top plan view of the frame of the embodiment shown in FIG. 1.
Figure 4:
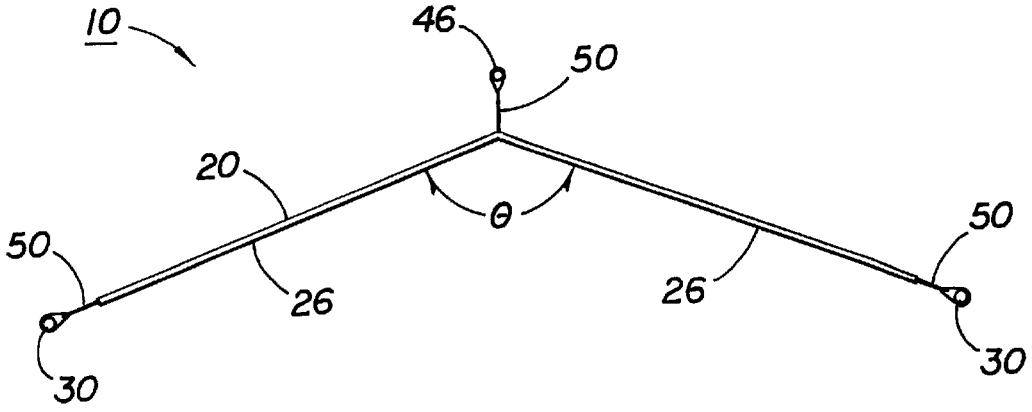
FIG. 4 is a top plan view of another embodiment of the present invention.

Still referring to FIGS. 3 and 4, the desired angle θ of the pivot point 40, and correspondingly the net 20, in the presently preferred embodiment is between 90 and 170 degrees, more preferably between 125 and 145 degrees, and most preferably at 135 degrees.

Preferably, the net 20 is constructed of a nonelastic material, such as nylon or cotton, and the connecting means further comprises a means for elastically securing the net 20 to the members of the frame 38. It is preferred that the net 20 be rectangular, 30 similar to the frame 38. It is also preferred that the net 20 be a knitted 1.5 inch mesh size.

The elastically securing means comprises one elastic segment 50 connecting each corner 39 of the frame 38 to the net 20 and an elastic segment 50 connecting each pivot point 40 to the horizontally disposed edges 24 of the net 20. The elastic segments 50 are selected from the group of a spring, an elastomeric cord, a shot cord, or other device or material known in the art. It is preferred that the elastic segments 50 be highly elastic to rebound the ball contacting the net 20 effectively.

Figure 2:
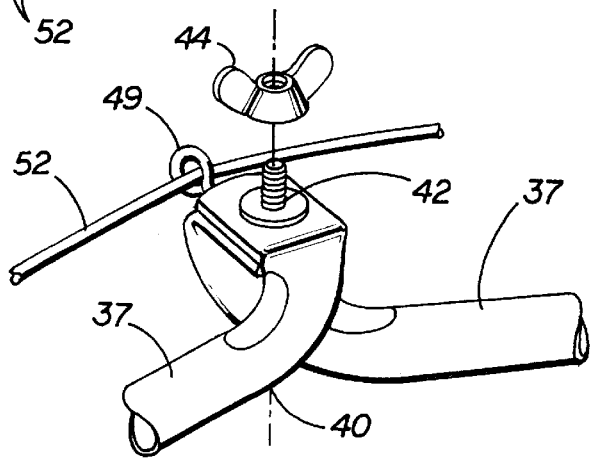
FIG. 2 is an enlarged view of the pivot point of the embodiment shown in FIG. 1.

Another embodiment of the present invention uses at least one cord 52 circumscribing the body portion 22 of the net 20 along its edge 24, as shown in FIG. 1. The cord 52 is attached to the corners 39 of the frame 38 and the pivot points 40 so that the net 20 is disposed substantially parallel to the members of the frame 38. As shown in FIG. 2, the cord 52 is connected to the pivot point 40 by a hook 49. Thus, there are four cords 52 so that there is one cord 52 is adjacent to each of the four edges 24 of the rectangular net 20. Still another embodiment can use an elastic material for the net, which is securely attached directly to the members of the frame 38.

As shown in FIG. 1, the ball returning device 10 further comprises a means for supporting the frame 38 in an upright position. The supporting means comprises a stand 60 that has two supports 62. Each support is substantially U-shaped and has two opposed ends 64 in which each end of the support is attached to a horizontal member of the frame 38 intermediate its end 36 and pivot point 40. The supports 62 may pivot to provide the greatest amount of stability possible and to allow storage. Specifically, it is preferred that the pivot points 40 allow the ball return device 10 to fold into half its extended size and the supports 60 pivot into the net for easy storage.

Still referring to FIG. 1, the present invention further comprises a second net 70 secured to the upright members 30. The second net 70 has a horizonal top edge 72 disposed intermediate the horizonal members 34. Preferably, the second net 70 is similar to a tennis net and does not elastically rebound the ball. This second net 70 is advantageous because it forces the player to aim at a certain point above the center net. If the ball is hit too low, it will strike the nonelastic second net 70 and interrupt play, which similarly occurs during a tennis game on a court. The net 20 can be a color, such as black, that contrasts with the second net 70, which is preferably white. The second net 70 is a 15/16 inch mesh size, similar to a center net.

The height of the top edge 72 of the second net 70 can be adjusted as desired so that the second net 70 emulates the center net on a tennis court. Alternatively, the second net 70 can be positioned based on the type of practice that the player is performing. For example, when practicing ground strokes, the second net 70 should be positioned lower than a center net on a tennis court. Also, the consideration exists that the player will be consistently closer to the net 20 so the player may desire to alter the height of the second net 70 accordingly.

It is also contemplated that the net 20 can comprise multiple, individual net segments in which each net segment forms one of the sections 26 of the net 20.

In an alternate embodiment shown in FIG. 4, the positioning means comprises at least one elongated positioning member 46 located intermediate the upright members 30 and in a nonlinear relationship with the upright members 30. Similar to the embodiment using a frame 38 discussed above, the connecting means connects at least a portion of the net 20 to each positioning member 46 so that at least two sections 26 are formed in the net 20. An elastic segment 50 connects each end 32 of the upright members 30 to the net 20 and at least two elastic segments 50 connect the positioning member 46 to opposed edges 24 of the net 20. Other variations of this embodiment include disposing eyebolts (not shown) in a garage or beneath a porch to form the net 20 of the present invention. For example, six eyebolts can be disposed in a garage and the net 20 attached to these eyebolts by the elastic connecting means so that at least two sections 26 are formed in the net 20 that have a desired angle θ therebetween. Also, similar to the preferred embodiment discussed above, this embodiment of the present invention may use similar modifications, such as a second net 70 adjustably secured to the upright members 30.

The present invention allows a player to practice hitting a ball, such as tennis. The tennis player hits the ball toward the net 20 so that the ball contacts the surface of the net 20. The net 20 then elastically rebounds the ball from its surface in a direction substantially toward the player so that the player may hit the ball again. The player's repeatedly hitting the same ball as the net 20 elastically rebounds that ball can occur for as long as the player's skills and endurance allow. The present invention can also be used in other ball sports, such as practicing baseball fielding and cricket.

The nonlinear sections 26 that exist in the present invention cause a ball to rebound differently compared to prior art devices. Instead of following a reasonably expected trajectory after rebounding from a flat surface, the present invention provides an unexpected trajectory. This improves the quality of the practice session.

Different rebound trajectories occur depending on the location that the ball contacts the net 20. When the ball hits near the intersection of the adjacent sections 26 of the net 20, it returns most predictably and with the smallest velocity loss. However, return speed is less than the impact speed because of energy losses that occur. As will be appreciated, the tension in the elastic segments 50 can be adjusted so that the return time is substantially equivalent to the time that it takes the ball to travel across a full-sized court and back in an actual tennis volley. This provides the advanced player with a delay in return that allows him to hit strokes at full force in succession. In contrast, a backboard or a wall does not slow down the returning ball so that the player must position himself at a sufficient distance from the surface to practice. Adjusting the tension also allows a player to practice in small areas, such as a garage.

Figure 5A:
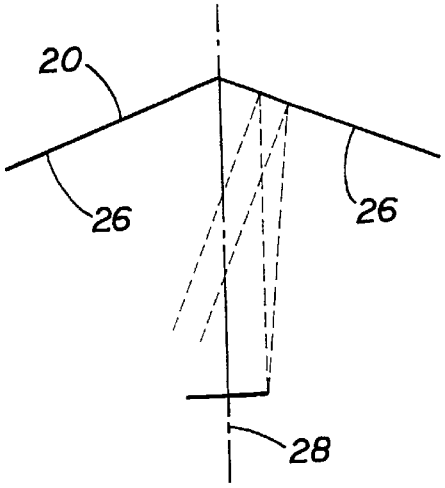
FIGS. 5A to 5D are top views of the present invention in schematic form showing approach and rebound trajectories of a ball in phantom lines.
Figure 5B:
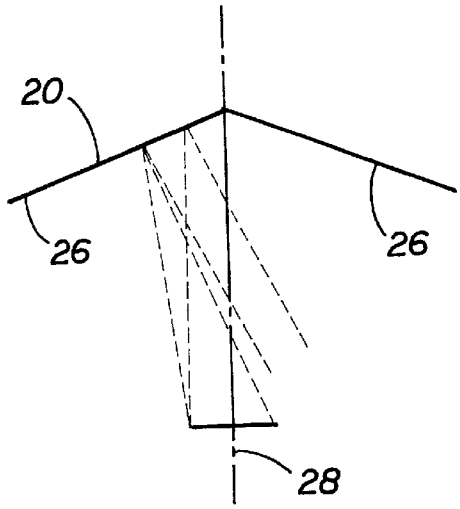

Since the multiple sections 26 of the net 20 in a nonlinear arrangement result in different return characteristics, the present invention allows a change in direction of the ball so that both backhand and forehand shots can be practiced. For a right-handed player, the ball hitting the right side of the net 20 that has two sections 26 returns the ball to the player's backhand. This is shown in FIG. 5A, in which two different ball trajectory paths are shown in phantom lines. As shown in FIG. 5B, the ball hitting the left side of the net 20 returns the ball to the right-handed player's forehand. The opposite situation exists for a left-handed player.

The rebounding ball returns substantially perpendicular to the surface of the net 20. Thus, as the location of the impact varies horizontally along one section 26 of the net 20, the return trajectory also varies. This varied return characteristic of the present invention does not intuitively follow the novice player's expectations and, accordingly, creates an element of surprise. The advanced player, however, who can control the direction of every stroke, can become accustomed to the return trajectories so that they become predictable. Thus, it is possible for the advanced player to practice both backhand and forehand shots at full force while the player's skill level is constantly challenged.

Figure 5C:
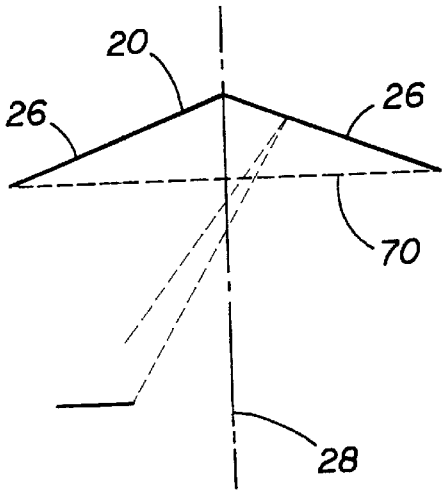

FIGS. 5A and 5B show the trajectories for a player positioned on the axis 28 bisecting the intersection of two adjacent sections 26 of the net 20. If the player is located on either side of the axis 28, as shown in FIG. 5C, it is possible to practice cross-court strokes in succession. For example, when a right-handed player hits a forehand shot to the right while being on the left side (back-hand side) of the court, this is a "run around" forehand shot. This stroke is effective in tennis matches because it can be hit with more force and higher velocity than the expected backhand shot. The present invention allows a player to practice this difficult, but powerful, stroke. This shot, obviously, cannot be practiced with the prior art devices. Without the present invention, the only other effective way to practice this shot is with a training partner who has sufficient skill to return the cross-court stroke consistently.

Figure 5D:
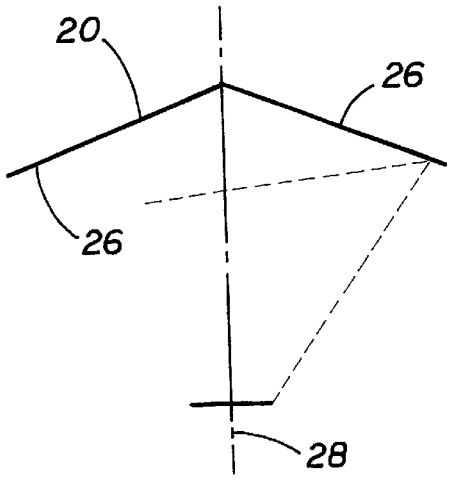

FIG. 5D shows the rebound trajectory when the ball is hit to the corner of the net 20, particularly to the top corner. The corner areas of the net 20 have a larger tensile force applied than the other parts of the net 20 because of their proximity to the elastically securing means. The return trajectory of the ball from the corner area is sharp in the inward and downward direction, which simulates a "drop shot." Again, this is not possible with the prior art devices.

A further advantage of the present invention is that it allows a player to practice serving a tennis ball effectively. The present invention allows the user to develop and practice his serve by the combination of the net 20 that absorbs energy, the second net 70 that is vertically adjustable, and the different rebound characteristics of the net 20.

Although the present process has been described with reference to specific details of certain embodiments thereof, it is not intended that such details should be regarded as limitations upon the scope of the invention except as and to the extent that they are included in the accompanying claims.

What is claimed is:

1. A ball returning device, comprising:

a. one net having a body portion and an edge circumscribing the body portion including a top edge and a bottom edge and a ball rebounding surface; and b. means for supporting the one net in a substantially upright position with the top edge disposed above the bottom edge so as to elastically rebound a ball contacting the net, the supporting means orienting the net so that the body portion forms at least two sections in which an intersection of adjacent sections forms an angle therebetween and the intersection extends substantially vertically alone the net between and including the top edge and the bottom edge thereof, each of the sections being substantially planar intermediate the top and bottom edges of the net. and wherein the angle is other than 0 degrees and other than 180 degrees so that the two sections are disposed oriented nonlinearly relative to each other in a horizontal plane, and wherein the net supporting means comprises:

two substantially upright members disposed on opposite edges of the net, each upright member having opposed ends;

means, disposed intermediate the upright members, for positioning the sections of the net relative to each other; and means for connecting the net to the upright members and the positioning means.

2. The ball returning device of claim 1, wherein the positioning means comprises two substantially horizontally disposed members, each horizonal member having opposed ends and a pivot point disposed therebetween, each end of each horizonal member being connected to one end of one upright member to form a corner so that the two upright members and two horizonal members form a frame, wherein the pivot point allows the ends of the respective horizonal member to be pivoted relative to each other, the pivot point causing the horizonal member to be nonlinear, and wherein the connecting means connects at least a portion of the net to the pivot points, whereby the two sections are formed in the net having an angle therebetween substantially the same as the angle formed by the pivot point.

3. The ball returning device of claim 2, wherein the pivot point forms an angle greater than 0 degrees and less than 180 degrees, whereby the net is substantially "V" shaped in the horizonal plane.

4. The ball returning device of claim 2, wherein the net is constructed of a non-elastic material and the connecting means comprises an elastic segment connecting each of the corners of the frame to the net and an elastic segment connecting each of the pivot points to the net.

5. The ball returning device of claim 2, further comprising a second net secured to the upright members in front of a portion of the ball rebounding surface of the net, the second net having a horizonal top edge disposed intermediate the horizonal members, wherein the second net is substantially non-rebounding.

6. The ball returning device of claim 1, wherein the positioning means comprises an elongated positioning member located intermediate the upright members and in a nonlinear relationship therewith, wherein the connecting means connects at least a portion of the net to the positioning member, whereby the two sections are formed in the net.

7. The ball returning device of claim 6, wherein the net is constructed of a non-elastic material and the connecting means comprises an elastic segment connecting each end of the upright members to the net and at least two elastic segments connecting the positioning member to the net.

8. The ball returning device of claim 6, further comprising a second net secured to the upright members, the second net having a horizontally disposed top edge, wherein the second net is substantially non-rebonding.

9. The ball returning device of claim 5, wherein the second net extends from one upstanding member to the other upstanding member.

10. The ball returning device of claim 8, wherein the second net extends from one upstanding member to the other upstanding member.

11. A ball returning device, comprising:

a. a frame having four members, each member having two opposed ends in which each end is connected to one end of the adjacent member to form a corner, each member being disposed substantially parallel to another one of the members so that the frame comprises two horizontally disposed members and two substantially upstanding members;

b. means for pivoting the ends of the horizonal members relative to each other, the pivoting means forming a pivot point in each horizonal member that is located intermediate the opposed ends;

c. one net having a body portion and an edge circumscribing the body portion, at least a portion of the body portion being disposed intermediate the members of the frame, the net having a height which is the portion thereof disposed between the horizontal members of the frame; and d. means for elastically securing the one net to the members of the frame so that the pivot point in each horizontal member forms an angle greater than 0 degrees and less than 180 degrees, wherein the net forms two upstanding sections in which each section is substantially planar intermediate the horizontal members of the frame, an intersection of the two sections extending substantially vertically the height of the net, the intersection of the two sections being at substantially the same orientation as the angle of the pivot points so that the two sections are disposed at other than 0 degrees and other than 180 degrees relative to each other wherein the two sections are oriented nonlinearly in a horizontal plane.

12. The ball returning device of claim 11, wherein the net is constructed of a non-elastic material.

13. The ball returning device of claim 11, wherein the net is rectangular.

14. The ball returning device of claim 11, further comprising two supports, each support being substantially U-shaped and having two opposed ends in which each end is pivotally attached to a different horizontal member of the frame intermediate its end and pivot point, and wherein a portion of each support is vertically disposed intermediate the two ends thereof.

15. The ball returning device of claim 11, wherein the elastically securing means comprises at least one cord circumscribing the entire body portion of the net along its edge, the cord being attached to the four corners of the frame and the two pivot points only so that the sections of the net are disposed substantially parallel to the members of the frame to form the two sections in the net.

16. The ball returning device of claim 11, wherein the elastically securing means comprises an elastic segment connecting each of the corners of the frame to the net and an elastic segment connecting each of the pivot points to the horizontally disposed edges of the net.

17. The ball returning device of claim 16, wherein the elastic segments are selected from the group of a spring, an elastomeric cord, and a shot cord.

18. The ball returning device of claim 11, further comprising a second net secured to the frame in front of a section of the body portion, the second net having a horizonal top edge disposed intermediate the horizonal members of the frame, wherein the second net is substantially non-rebounding.

19. The ball returning device of claim 18, wherein the second net extends from one upstanding member to the other upstanding member.

20. The ball returning device of claim 11, wherein the pivoting means further comprises means for locking the pivot point when the pivot point when the pivot point forms the desired angle.

21. The ball returning device of claim 20, wherein the locking means comprises:

a. a bolt having a head and a shaft disposed through a portion of the pivot point, a portion of the shaft being threaded; and b. a nut having a threaded bore of a size to be complementarily received on a portion of the shaft of the bolt, wherein when the nut is moved along the shaft toward the head of the bolt, the pivot point is tightened to be held at the desired angle.

22. The ball returning device of claim 11, wherein the angle between adjacent sections is substantially 145 degrees or less.

23. The ball returning device of claim 11, wherein the angle between adjacent sections is substantially 135 degrees or less.

* * * * *